United States Patent [19]

Vanderhoof

[11] 4,252,036

[45] Feb. 24, 1981

[54] WRENCH FOR 4-WHEEL DRIVE

[76] Inventor: Richard C. Vanderhoof, Steward Rd., R.D. #1, Corry, Pa. 16407

[21] Appl. No.: 12,843

[22] Filed: Feb. 16, 1979

[51] Int. Cl.[3] ..... B25B 13/48

[52] U.S. Cl. ..... 81/461; 81/119

[58] Field of Search ..... 81/71, 90 R, 90 D, 119, 81/121 A

[56] References Cited

U.S. PATENT DOCUMENTS

| | | | |
|---|---|---|---|
| 2,383,573 | 8/1945 | Tomsek | 81/71 |
| 2,719,042 | 9/1955 | Espy | 81/71 X |
| 4,100,663 | 7/1978 | Crum | 81/71 X |

*Primary Examiner*—James G. Smith

[57] ABSTRACT

A wrench for engaging the front wheel of a 4-wheel drive vehicle by releasing the drive to the front wheel. The wrench has a cylindrical body with flat end part of which is narrowed for hand receiving part, a slot rectangular in cross section is formed in one end to receive a rib of a 4-wheel drive.

1 Claim, 5 Drawing Figures

WRENCH FOR 4-WHEEL DRIVE

GENERAL DESCRIPTION OF THE INVENTION

Some 4-wheel drive vehicles have a mechanism by which the front wheel drive mechanism can be disconnected from the front wheels when four wheel drive is not needed to eliminate the friction in the drive, thereby conserve fuel.

Persons who do not have strong hands sometimes have difficulty releasing these locks manually and the lock release handles are somewhat inconvenient to grasp with the fingers. Applicant has discovered that by providing a tool as disclosed herein the drive locks can be readily and conveniently released without touching them with the hands.

OBJECTS OF THE INVENTION

It is an object of the invention to provide an approved tool for releasing a 4-wheel drive of a vehicle.

Another object of the invention is to provide a combination tool and 4-wheel drive lock.

Another object of the invention is to provide a tool for unlocking a 4-wheel drive mechanism that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE INVENTION

DETAILED DESCRIPTION OF THE DRAWINGS

Figure 1:
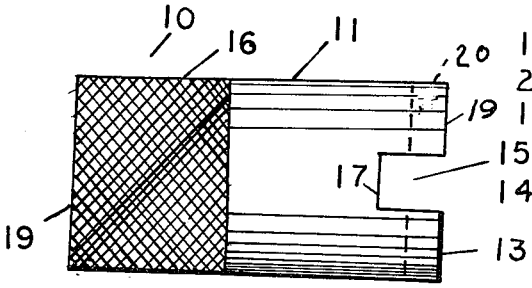
FIG. 1 is a side view of the tool according to the invention.
Figure 2:
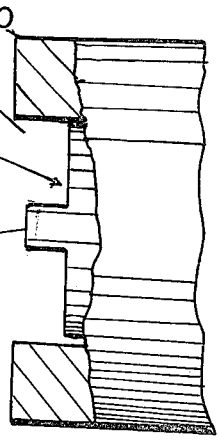
FIG. 2 is a side view of partly in cross-section of the wheel hub on which the device is intended to be used.
Figure 3:
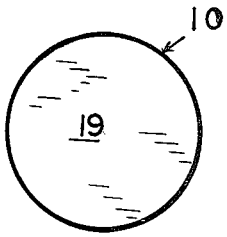
FIG. 3 is a left end view of the tool according to the invention.
Figure 4:
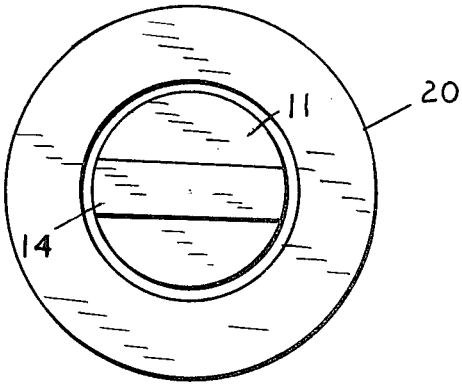
FIG. 4 is a side view of the hub shown in FIG. 2.
Figure 5:
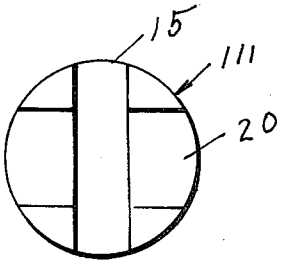
FIG. 5 is a right end view of the tool.

Now, with more particular reference to the drawings, a tool 10 is shown for rotating the lock 12 on it. The lock 12 has a rib 14 which can be received in the slot 15 of the tool 10. The hub 20 is an example of the type of hub found on the 1978 Ford 4-wheel drive vehicles.

The tool 10 has a cylindrical body 11 which has a first rectangular slot 15 and a second rectangular slot 20 formed in one end, the slots are cut at right angles to each other and parallel to the diameter of it, slot 20 is about twice as deep and wider than slot 15, and the body 11 is generally cylindrical having a body part 17 and knurled end 16 receiving to be grasped.

When the end body 11 is inserted into the recess 18 in the hub 20, the slot 15 will receive the rib 14 and the rib 14 can be rotated thereby locking or unlocking the hub 20 from the drive. The tool 10 has flat ends 13 and 19 which are perpendicular to the sides of the body part 11. The sides of the slots 15 are planar and parallel to a diameter of body part 11. The bottom of the slot 15 is flat and perpendicular to the sides of slot 15, thus, when in use the rib 14 is snugly fitted into the slot 15.

The foregoing specification sets forth the invention in its preferred, practical forms but the structure shown is capable of modification within a range of equivalents without departing from the invention which is to be understood is broadly novel as is commensurate with the appended claims.

I claim:

1. A wrench for rotating a rib in the hub of a four wheel drive automobile for engaging and disengaging a drive.

said wrench having a solid cylindrical shaped body adapted to be received in a recess in said hub, said wrench having a slot with flat sides in one end, said slot being adapted to receive said rib and a knurled end on said cylindrical body to be engaged by a hand of an operator to rotate said wrench and said rib, a second slot formed in said tool end, said second slot being disposed at right angles to said first slot, twice as wide and half as deep as said first slot.

* * * * *